US006399266B1

(12) United States Patent
Kabai

(10) Patent No.: US 6,399,266 B1
(45) Date of Patent: Jun. 4, 2002

(54) DEVELOPING AGENT AND METHOD FOR MANUFACTURING THE SAME

(75) Inventor: Takahito Kabai, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/776,860

(22) Filed: Feb. 6, 2001

(51) Int. Cl.[7] ..... G03G 9/08
(52) U.S. Cl. ..... 430/137.11; 430/137.2
(58) Field of Search ..... 430/137.1, 137.11, 430/137.14, 137.18, 137.19, 137.2, 137.21, 110.1, 110.2, 137

(56) References Cited

FOREIGN PATENT DOCUMENTS

| | | | |
|---|---|---|---|
| JP | 5-107810 | * | 4/1993 |
| JP | 6-161152 | * | 6/1994 |
| JP | 7-77833 | | 3/1995 |
| JP | 11-7155 | | 1/1999 |

OTHER PUBLICATIONS

Japanese Patent Office Machine Assisted Translation of JP 5–107810, Apr. 1993.*

Japanese Patent Office Machine Assisted Translation of JP 6–161152, Jun. 1994.*

* cited by examiner

*Primary Examiner*—Janis L. Dote
(74) *Attorney, Agent, or Firm*—Foley & Lardner

(57) ABSTRACT

Colorless toner particles containing a binder resin and a pigment wetted in advance are wet-mixed so as to obtain wetted toner particles, and thus obtained wetted toner particles are dried, thus obtaining toner particles.

5 Claims, 2 Drawing Sheets

DEVELOPING AGENT AND METHOD FOR MANUFACTURING THE SAME

BACKGROUND OF THE INVENTION

The present invention relates to a developing agent and a method of manufacturing such a developing agent.

Conventionally, a so-called mechanical pulverizing method is generally used for manufacturing a color developing agent, as in the case of the monochrome developing agent manufacturing method. In the mechanical pulverizing technique, first, a binder resin and a pigment are fused and mixed together and the mixture is kneaded, and then the kneaded material is subjected to pulverizing and classifying, thus obtaining toner particles. Further, an additive is added to thus obtained toner particles, and thus a developing agent is obtained. However, when the mechanical pulverizing method is applied to manufacture of a color developing agent, it is required to clean the manufacturing equipment parts each time when they are used to manufacture a developing agent of a different color. In particular, the cleaning of the kneading device and pulverizing and classifying device is very complicated due to the structures of these devices, thus requiring a great amount of time. For this reason, the manufacture of a color developing agent has a low productivity, and involves a high production cost, as compared to the case of the monochrome developing agent.

In order to bring a solution to these drawbacks, there has been recently proposed such a technique that colorless toner particles which do not contain a pigment are prepared and the pigment is attached onto the surfaces of the colorless toner particles. According to this technique, those steps from the fusing and kneading step for toner materials to the pulverizing and classifying step can be carried out in batch for manufacturing developing agents of any colors. Therefore, the time required for cleaning the kneading device and pulverizing and classifying device, can be shortened, thus making possible to enhance the productivity. Thus, it becomes possible to provide a more inexpensive color developing agent.

However, the pigment is in the form of solid secondary aggregate, and therefore it is conventionally difficult to sufficiently disperse it when it is attached onto the surfaces of colorless toner particles by dry-type mixture using a mixer or the like. Therefore, the color developing agent obtained by this method entails drawbacks such as a low dispersibility of the pigment, a low chromatic saturation, a narrow color reproduction range, a low transparency and the like.

BRIEF SUMMARY OF THE INVENTION

The first object of the present invention is to provide a method of manufacturing a developing agent which has a high pigment dispersibility, and which can achieve a high transparency and a high color reproducibility at low cost, particularly when a color developing agent is manufactured.

The second object of the present invention is to provide a developing agent which has a high pigment dispersibility, and which can achieve a high transparency and a high color reproducibility at low cost, particularly when a color developing agent is manufactured.

According to the first aspect of the present invention, there is provided a method of manufacturing a developing agent, comprising:

a wet-type mixture step for mixing colorless toner particles containing a binder resin and a pigment wetted in advance, together in a wet-mixture manner, thereby obtaining wet toner particles; and a drying step for drying the wet toner particles, thereby obtaining toner particles.

According to the second aspect of the present invention, there is provided a developing agent comprising toner particles obtained by mixing colorless toner particles containing a binder resin and a pigment wetted in advance, together in a wet-mixture manner, thereby obtaining wet toner particles, and drying the wet toner particles.

In the manufacture of the developing agent of the present invention, colorless toner particles which do not contain pigments are prepared, and then the particles are mixed with pigments. With this manufacturing structure, up to the preparation of toner particles, those steps can be carried out in batch without having to clean the part devices regardless of the color of the developing agent, thus making it possible to enhance the productivity and lower the production cost.

Further, in the present invention, a pigment which is easily secondary-aggregated when dried is mixed in a wet manner with the colorless toner particles before being dried, and therefore the dispersibility of the pigment in thus obtained toner particles becomes very high. Therefore, the present invention can provide a developing agent having an excellent color reproducibility and a high transparency.

Additional objects and advantages of the invention will be set forth in the description which follows, and in part will be obvious from the description, or may be leaned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
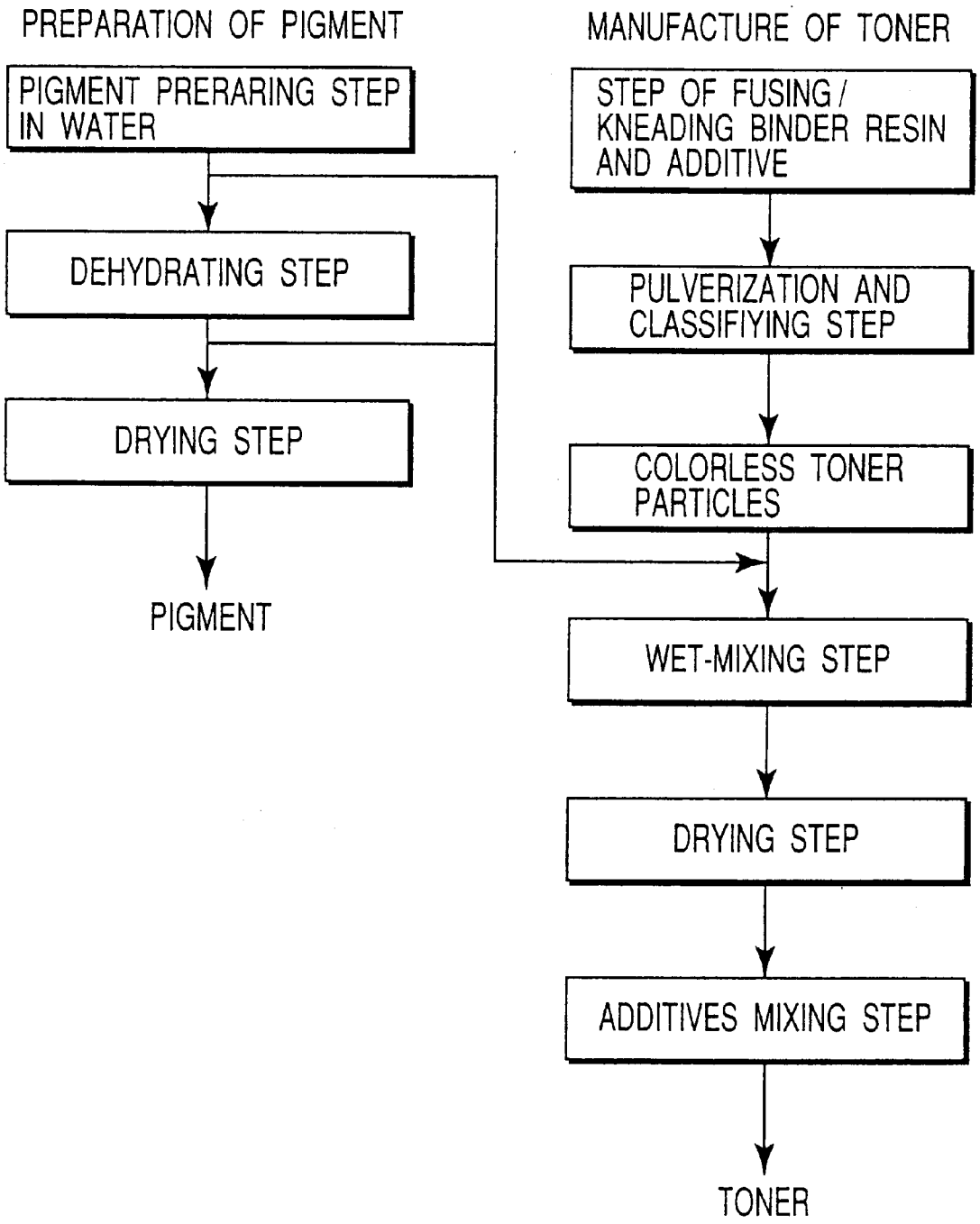
FIG. 1 is a flow chart for explaining a method for manufacturing a developing agent according to the present invention.

The method of manufacturing a developing agent, according to the present invention, has:

a wet-type mixture step for mixing colorless toner particles containing binder resin and pigment wetted in advance, together in a wet-mixture manner, thereby obtaining wet toner particles; and a drying step for drying the wet toner particles, thereby obtaining toner particles.

Further, the developing agent according to the present invention is a developing agent obtained by the above method, which comprising toner particles consisting of colorless toner particles containing a binder resin, and a pigment attached to the surfaces of the colorless toner particles, and the toner particles are obtained by mixing colorless toner particles containing binder resin and pigment wetted in advance, together in a wet-mixture manner, thereby obtaining wet toner particles, and drying thus obtained wet toner particles.

The colorless toner particles are of a type which contains a binder resin, but does not substantially contain a coloring agent such as a pigment. If necessary, the colorless toner particles may contain various types of additives, such as wax, a charge controlling agent, a lubricant, a cleaning auxiliary and fluidizing agent.

Preferable examples of the wax are polypropylene wax, polyethylene wax, ester wax, and natural ester wax.

Preferable examples of the charge controlling agent are salicylate metal complex, calixarene compound, organic boron compound and fluorine quaternary ammonium salt.

As the colorless toner particles, those obtained by the mechanical crushing or polymerizing method can be used.

The mechanical pulverizing method has, for example, a step of melting and kneading a colorless toner particle material which contains a binder resin and, if necessary, an arbitrary additive, but does not contain a coloring agent; a step for drying thus obtained kneaded material and pulverizing it; and a step of classifying the kneaded material.

The polymerizing method has, for example, a step of polymerizing a binder resin raw material containing a resin monomer, and at least one selected from the group consisting of oligomer and pre-polymer, and if necessary, an arbitrary additive.

In the present invention, colorless toner particles which do not contain a pigment are prepared and then they are mixed with the pigment. In the case where the toner particles contain a pigment, it is required to clean the manufacture devices which are used, each time a developing agent material of a different color is introduced. However, in the present invention, the toner particles do not contain a pigment, and therefore up to the step of preparing the toner particles, the steps involved in the manufacture of the developing agent can be performed in batch regardless of the color of the developing agent. Therefore, when the method of the present invention is employed, the productivity becomes high and the production cost is decreased. Further, according to the present invention, a tendency of a pigment to secondarily agglomerate can be improved by wet mixing, so that a good pigment dispersibility can be achieved. Thus, a developing agent having an excellent color reproducibility and transparency can be obtained.

FIG. 1 is a flowchart designed to for illustrate an example of the method of the present invention.

As indicated in the flowchart, in this method, colorless toner particles are obtained by, first, melting and kneading a colorless toner particle material containing a binder resin and, if necessary, an additive, and then pulverizing thus obtained kneaded material.

Further, as shown in FIG. 1, many of the pigments are synthesized, for example, in water.

In many of the primary crystals of the pigment obtained by such synthesis, particles collide with each other after they are synthesized, so as to become primary particles. The synthesized pigment is subjected to a dehydrating process with a processing device such as a filter press. After the dehydrating process, the pigment still contains about 50 to 80% by weight of water, and therefore the aggregation of the primary particles can be prevented.

Usually, the dehydrated pigment is further subjected to a drying step. In the drying step water is removed from the pigment, and it becomes powder. The powder pigment is then easily aggregated to become a secondary aggregate. The powder pigment is lighter in weight than a pigment which is simply dehydrated, and therefore is advantageous in terms of storage and carriage. Therefore, a generally available pigment is a powder pigment consisting of such a secondary aggregate.

However, it requires a high stress force in order to crash a pigment in the form of the secondary aggregate to primary aggregate. In the case where toner particles and powdered pigment are dry-mixed with each other, if such a high stress force that can crash the secondary aggregate to primary aggregate is applied, the toner particles are undesirably fused.

When the dispersion of pigment within toner is poor, it is known that the color saturation is decreased and the transparency is deteriorated.

In order to avoid the above-described drawbacks, according to this method, the colorless toner particles are wet-mixed with a pigment which has been wetted in advance, which is, for example, unfinished pigment which has not yet been dried in the pigment preparation process as shown in the flowchart. The unfinished pigment should be wetted with preferably water, and in a state in which pigment synthesized in water is not dehydrated, or dehydrated.

As described above, the pigment which has not been subjected to the drying process does not form the secondary particles, and therefore the dispesibility of the pigment is much better as compared to the case of powder pigment. Therefore, when an unfinished pigment is used during the wet mixing, the particles of the pigment can be adhered onto the colorless toner particles in a more uniformly dispersed manner. Naturally, with the unfinished pigment, the production cost becomes less than the case of powder pigment.

The wetted toner particles obtained by the wet mixing are later subjected to a drying process, and thus toner particles are obtained.

The toner particles constitute toner solely by themselves, or as mixed with an additive such as a charge controlling agent, a lubricant, a cleaning auxiliary, a fluidizing agent or the like.

As the pigment wetted in advance, it is possible, in addition to the unfinished pigment, to use a dried pigment to which the above-described liquid component has been added. With use of the wetted pigment thus obtained, the particles can be dispersed well by the wet mixing. However, the case which uses the unfinished pigment can achieve a higher dispersibility as well as a lower production cost.

When the color of the developing agent to be manufactured is changed, the necessary pigment is added after the preparation of the colorless toner particles. With this structure, it is not necessary to clean the devices used for the fusing and kneading step and the pulverizing and classifying step, which take place before the step of adding a pigment, each time the color of the developing agent is changed. When the number of the cleaning operations is reduced in the manufacture of the developing agent, the production cost for the developing agent can be further decreased.

During the wet mixing, an additive selected from the liquid components, surfactant and the like can be arbitrarily added to the above-described unfinished pigment and the colorless toner particles.

As the surfactant, fatty acid sodium soap, alkyl sulfate, alkyl ether sulfate, lauryl disodium sulfosuccinate, polyoxyethylenemonostearate, sorbitanmonostearate or the like can be used.

Figure 2:
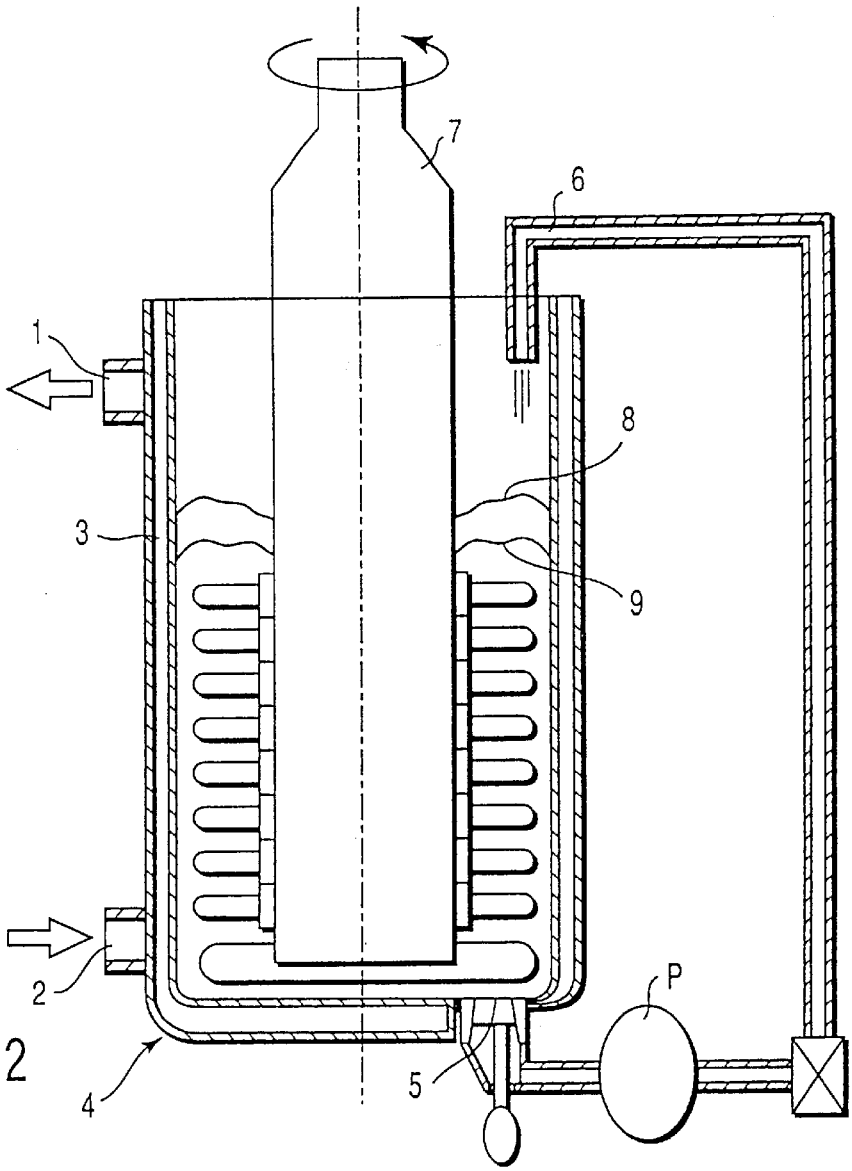
FIG. 2 is a diagram showing the structure of an example of an attritor which can be used for the present invention.

Further, as the mixing device used for the wet mixing, for example, such a batch-type attritor as shown in FIG. 2 can be used.

This batch-type attritor has, as shown in FIG. 2, an inlet 1 and an outlet 2 for coolant water, which are provided on the outer surface thereof, a jacket 3 which can constitute a space in which the coolant water is allowed to flow, a discard outlet 5 provided on the bottom portion thereof, for discarding a content material, a container main body 4 having a supply tube 6 connected to the discharging outlet in order to circulate the content material discharged by supplying the material back to the container, and having an opening at its upper end, and a agitator 7 provided within the container main body 4.

In the batch-type attritor, first, while coolant water is allowed to flow in the jacket 3 in order to cool down the container main body 4, for example, a ceramic-made ball having a diameter of 5 mm to 50 mm (not shown) is put into the container main body 4 down to a ball surface 9 indicated in the figure, and then a mixture containing a pigment wetted in advance, colorless toner particles, and if necessary, liquid components and surfactant and the like, is introduced on top of the ball down to a slurry surface 8. Then, the agitator 7 is rotated at, for example, 1500 rpm for agitating the mixture. Thus agitated mixture is discharged from the discharging outlet 5, and sent by a pump P to the supply tube 6. Then, the mixture is introduced from the upper section of the container main body 4 back into the container main body 4, to be circulated.

With this device, the agitator 7 and ceramic ball serve to apply a stress force on the content material, and therefore an excellent wet mixing can be performed.

As the binder resin which can be used in the developing agent, a polyester resin, polystyrene resin, styrene/acrylate copolymer resin, polyester-styrene/acrylate hybrid resin, epoxy resin and polyether.polyol resin may be used.

As the wax, natural waxes such as rice wax and carnauba wax; petroleum waxes such as paraffin wax; and synthetic waxes such as fatty ester, fatty amide, low molecular weight polyethylene and low molecular weight polypropylene, may be used.

Preferable examples of the pigment of the present invention are pigments including a carbon black, organic pigment and inorganic pigment are used. The coloring agent is not particularly limited. However, for example, as the carbon black, acetylene black, furnace black, thermal black, channel black, and ketchen black may be used. As the pigment, Fast Yellow G, Benzidine Yellow, Indofast Orange, Irgazine Red, Carmine FB, Carmine 6B, Permanent Bordeaux FRR, Pigment Orange R, Lithol Red 2G, Lake Red C, Rhodamine FB, Rhodamine B Lake, Phthalocyanine Blue, Pigment Blue, Brilliant Green B, Phthalocyanine Green, and Quinacridon may be used singly or in combination.

If necessary, other additives such as a charge controller, an interior/exterior lubricant, a cleaning additive, and a fluidizing agent may be added into the toner particle material of the developer or onto the surfaces of thus obtained toner particles.

Now, a full color electrophotographic device using a two-component full color developing system capable of using the developing agent of the present invention will be explained with reference to FIG. 3.

Figure 3:
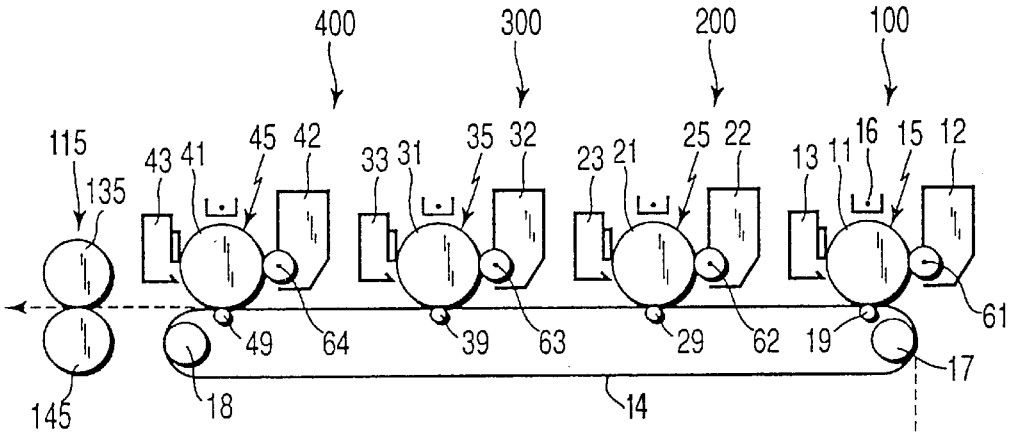
FIG. 3 is a schematic view showing one embodiment of an image forming apparatus to which the developing agent according to the present invention can be applied.

In FIG. 3, a photoreceptor drum 11 as an image carrier is a multi-layered organic photoreceptor drum. The photoreceptor drum 11 is provided rotatable in the direction indicated by an arrow in the figure.

Around the photoreceptor drum 11, the following elements are arranged along a rotation direction. A light exposure portion 15 is arranged for applying light to a surface of the photoreceptor drum 11 charged with a charging roller (not shown) to form an electrostatic latent image. On the downstream side, a developing device 12 is arranged which has a developing roller 61 and stores a developing agent of the present invention. In the developing device 12, an electrostatic latent image formed on the photoreceptor drum 11 is developed with the developing agent while applying a predetermined bias voltage. At the downstream side of the developing device 12, a conveying means 14 is arranged for conveying a transfer material, that is, a recording material, to the photoreceptor drum 21.

Furthermore, at the downstream side of the contact position of the photoreceptor drum 11 and the recording material, a blade cleaning unit 13 and a charge-removing lump (not shown) are arranged.

The conveying means 14 has substantially an equal width as that of the photoreceptor drum 11. The conveying means 14 is a loop formed of a belt. At the round portions of the upstream and the downstream sides of the conveying means 14, a tension roller 17 and a driving roller 18 are arranged respectively. The conveying means 14 is provided along the outer periphery of the tension roller 17 and the driving roller 18 at the round portions in contact with them.

The tension roller 17 and the driving roller 18 are rotatable in the direction indicated by arrows. The conveying means 14 is moved like drawing a loop along with the rotation of the driving roller 18. The transfer speed is controlled in synchronisms with the rotation speed of the photoreceptor body.

A process unit 100 is constituted of the photoreceptor drum 11, light exposure portion 15, developing device 12, and blade cleaning unit 13 and charge-removing lamp 16.

The process unit 100, a process unit 200, a process unit 300, and a process unit 400 are arranged on the conveying means 14 between the tension roller 17 and the driving roller 18 along the transfer direction. The process units 200, 300, 400 have the same constitution as the process unit 100.

More specifically, the photoreceptor drum 1, photoreceptor drum 21, photoreceptor drum 31 and photoreceptor drum 41 are arranged at substantially the center of respective process units, respectively. Around the photoreceptor drums, a light exposure portion 25, a light exposure portion 35 and a light exposure portion 45 are respectively arranged. At the downstream sides of the light exposure portions, a developing chamber 22 having a developing roller 62, a developing chamber 32 having a developing roller 63, a developing device 42 having a developing roller 64; and a blade cleaning unit 23, a blade cleaning unit 33, and blade cleaning 43 are respectively arranged in the same manner as in the process unit 100.

The different constitution between the process units is the developing agent stored in the developing chamber. For example, developing agents containing different coloring agents such as yellow, magenta, cyan and black are stored in the developing devices 12, 22, 32, 42, respectively. The developing agents are prepared in accordance with the method of the present invention and thus each contain at least a binder resin, toner particles obtained by wet mixing colorless toner particles containing wax and a pigment together, followed by drying the mixture, and a carrier.

When a color image is printed, the recording material is conveyed by the conveying means 14 while it successively comes into contact with the photoreceptor drums 1, 21, 31 and 41 in this order. At the positions at which each of the photoreceptor drums 11, 21, 31 and 41 is in contact with the recording material, power supply rollers 19, 29, 39 and 49 serving as transfer means are respectively arranged corresponding to photoreceptor drums 11, 21, 31, and 41 on one-to-one basis.

The power supply drums 19, 29, 39 and 49 are brought into contact with the conveying means 14, on the back side, at positions at which it is in touch with the corresponding photoreceptor drums 11 so as to face the photoreceptor drum 11 with the conveying means 14 interposed between them. Note that the power supply rollers 19, 29, 39 and 49 are individually connected to a bias power supply source (not shown). The power supply rollers 19, 29, 39 and 49 are rotated in accordance with the movement of the conveying means 14.

Now, an image forming process performed by the image forming apparatus thus constructed will be explained. The photoreceptor drums 11, 21, 31, and 41 rotating individually in four process units are uniformly charged by a charging means (not shown).

Light is applied to the uniformly charged photoreceptor drums 11, 21, 31, and 41 by light exposure portions 15, 25, 35, and 45 using a phosphor. In this manner, an electrostatic latent image is formed. In the developing chambers 12, 22, 32, 42, a bias voltage is applied to each of the electrostatic latent images to develop the latent image with sufficiently-charged developing agents having different colors.

On the other hand, the recording material is fed from a paper feeder cassette (not shown) to an image transfer portion of the photoreceptor drum 11.

When the recording material is fed to the image transfer position, a bias voltage of e.g., 1400V is applied to the conveying means 14 by each of the power supply rollers 19, 29, 39 and 49. Upon the application of the bias voltage, a transfer magnetic field is formed between each of the photoreceptor drums 11, 21, 31, and 41 and the conveying means 14. Accordingly, a developing agent image formed on the photoreceptor drum 11 is transferred to the recording material. The recording material having the developing agent image carried thereon is then moved to the photoreceptor drum 21. The developing agent image formed on the photoreceptor drum 21 is transferred on and overlapped with the developing agent image previously transferred on the recording material. The recording material is further moved to the photoreceptor drum 31 and thereafter to the photoreceptor drum 41, at which developing agent images of different colors are transferred in the same manner as mentioned above.

In this way, the recording material carrying the image formed by multiple transfer operations is sent to a fixing unit 115 by the conveying means 14. The fixing unit 115 has a heat roller 135 and a pressurizing roller 145. The recording material is passed through a space between the heat roller and the pressurizing roller while being in contact with the heat roller. In this manner, the image is fixed on the recording material.

Note that the aforementioned image forming apparatus is one of examples of the present invention. The present invention can also include a full-color image forming apparatus which is formed of single photoreceptor drum and a plurality of developing units in combination, and a monochrome image forming apparatus which is formed of a single photoreceptor drum and a single developing unit in combination.

EXAMPLES

Now, the present invention will be explained more specifically with reference to Examples.

Example 1

A colorless toner particle material having the composition specified below was prepared.

Composition of Colorless Toner Particle Material

| | |
|---|---|
| Polyester resin (Tm = 105° C.) | 96 wt % |
| Zr complex CCA | 1 wt % |
| PP wax | 3 wt % |

The colorless toner particle material was mixed using a Henshell mixer (a product of Mitsui Kozan Co. Ltd.), and then melted and kneaded by a continuous-type kneader. Thus obtained kneaded product was pulverized, for example, by a pin mill, followed by classifying with an I-type jet mill (a product of Hosokawa Micron) until a pulverized powder having an average diameter of about 8 μm was obtained. In this manner, colorless toner particles were obtained.

Then, a cyan toner material having the composition described below was put into an attritor (a product of Mitsui Kozan Co. Ltd.) having a structure similar to that shown in FIG. 2, and agitated for one hour. The size of the ball used here was 20 mm.

Wet Mixing Cyan Toner Material

| | |
|---|---|
| Thus obtained colorless toner particles | 48.5 wt % |
| Copper phthalocyanine pigment containing water at 50 % | 3 wt % |
| Surfactant | 1.0 wt % |
| Water | 47.5 wt % |

After that, the cyan toner material was dried with a spray drier (a product of Mitsui Kozan Co. Ltd.), and thus a cyan toner matrix was obtained.

To thus obtained cyan toner matrix, 1% by weight of hydrophobic silica R972 (a product of Japan Aerogil) was added. The mixture was dry mixed by a Henshell mixer (a product of Mitsui Kozan Co. Ltd.), and then subjected to a screening step. Thus, cyan toner A was obtained.

To 5% by weight of the cyan toner A, 95% by weight of resin coat ferrite carrier was mixed, thus obtaining a developing agent. Thus obtained developing agent was put in a full-color photocopier FC22 (a product of TOSHIBA TECH) having a structure similar to that shown in FIG. 3, and an image was output in a single color of cyan. The obtained image was measured and evaluated in terms of toner attachment amount in solid section, image reflection ID in solid section, fog ΔE, color saturation ΔC, image transmittance ID and projected image color generation.

It should be noted that the toner attachment amount in the solid section was measured on the basis of the difference in weight between a recording sheet before the image was formed, and that after a solid image was formed, and the area of the recording sheets.

The image reflection ID in the solid image was measured with regard to a solid image formed, with use of a Macbeth reflection density meter.

The fog ΔE and color saturation ΔC were each measured with X-Rite (a product of X-Rite Ltd.).

The image transmittance ID was measured with a Macbeth transmittance reflection density meter.

The projected image color generation was evaluated by human eye, and when it is very clear, a reference symbol ○ was given, whereas when it is not, a reference symbol × was given.

The obtained results were indicated in TABLES 1 and 2 below.

Comparative Example 1

As a comparative example 1, colorless toner particles similar to those of Example 1 and a cyan toner material 1 having the composition specified below were dry mixed by a Henshell mixer (a product of Mitsui Kozan Co. Ltd.), for 10 minutes, and then subjected to a screening step. Thus, cyan toner B was obtained.

Dry Mixing Cyan Toner Material

| | |
|---|---|
| Transparent toner | 96 wt % |
| Copper phthalocyanine pigment | 3 wt % |
| Hydrophobic silica R972 (a product of Japan Aerogil) | 1.0 wt % |

With use of thus obtained toner, a developing agent was prepared as in Example 1, and it was examined and evaluated in terms of the same items. The obtained results were indicated in TABLES 1 and 2 below.

It should be noted that the image transmittance ID was measured based on an image formed on OHP sheets (a product of 3M) by the OHP mode of FC 22 after the development conditions were adjusted to obtain the same transmittance density. The projected image color generation was evaluated by human eye, with regard to a projection image obtained by projecting thus obtained image with an OHP projector.

Comparative Example 2

A cyan toner particle material for mechanical pulverizing method having the composition specified below was prepared as Comparative Example 2.

Pulverization Cyan Toner Particle Material

| | |
|---|---|
| Polyester resin (Tm = 105° C.) | 93 wt % |
| Copper phthalocyan powder pigment | 3 wt % |
| Zr complex CCA | 1 wt % |
| PP wax | 3 wt % |

The cyan toner particle material for mechanical pulverizing method was mixed using a Henshell mixer (a product of Mitsui Kozan Co. Ltd.), and then melted and kneaded by a continuous-type kneader. Thus obtained kneaded product was pulverized, for example, by a pin mill, followed by classifying with an I-type jet mill (a product of Hosokawa Micron) until a pulverized powder having an average diameter of about 10 $\mu$m was obtained. In this manner, a cyan toner matrix C was obtained.

To thus obtained cyan toner matrix C, 1% by weight of hydrophobic silica R972 (a product of Japan Aerogil) was added. The mixture was dry mixed by a Henshell mixer (a product of Mitsui Kozan Co. Ltd.), and then subjected to a screening step. Thus, cyan toner C was obtained.

With use of thus obtained toner, a developing agent was prepared as in Example 1, and it was examined and evaluated in terms of the same items. The obtained results were indicated in TABLES 1 and 2 below.

TABLE 1

| | Toner attachment amount in solid section | Image reflection ID in solid section | Fog ΔE | Color saturation ΔC |
|---|---|---|---|---|
| Cyan toner A (Example) | 0.80 mg/cm$^2$ | 1.65 | 0.63 | 65 |
| Cyan toner B (Comparative Example 1) | 0.82 mg/cm$^2$ | 1.53 | 0.67 | 57 |
| Cyan toner C (Comparative Example 2) | 0179 mg/cm$^2$ | 1.68 | 0.66 | 64 |

TABLE 2

| | Image transmittance ID | Projected image color generation |
|---|---|---|
| Cyan toner A (Example) | 0.52 | ○ |
| Cyan toner B (Comparative Example 1) | 0.55 | X |
| Cyan toner C (Comparative Example 2) | 0.53 | ○ |

As can be understood from Table 1 above, when the image reflection ID is high, the coloring ability of the toner is strong. With a toner having a strong coloring ability, a sufficient image density can be obtained with a less amount of toner even for the same amount of pigment added, and therefore it is possible to provide a print image at low cost.

Further, if the color saturation is high when the toner attachment amounts on the images were made equal, the color reproduction range can be widened, and an impression of clear image can be obtained to human eyes.

From the results indicated in Table 1, the cyan toner A of Example, which was obtained by the wet mixing, has an image density of a similar level to that of the cyan toner C of Comparative Example 2, which was prepared by a general pulverization method. As compared to this, the cyan toner B of Comparative Example 1, which was prepared by the dry mixing, exhibits a low coloring power and a low color saturation, and therefore it is not practically sufficient.

From the results indicated in Table 2, the cyan toner A of Example, has a high transparency and exhibits a sufficient color generation as in the case of the cyan toner C of Comparative Example 2. As compared to this, the cyan toner B of Comparative Example 1 does not exhibit a sufficient transparency, and it is a projected image such as of a shadow picture of poor color generation.

From the Tables 1 and 2, it can be concluded that with the present invention, in which colorless toner particles and a pigment are wet-mixed, it is possible to obtain an image of a quality as high as that of the toner obtained by the conventional mechanical pulverizing method.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of manufacturing a developing agent comprising the steps of:

wet mixing colorless toner particles containing a binder resin and a pigment wetted in advance to obtain wet toner particles; and drying said wet toner particles, to obtain toner particles, wherein said pigment wetted in advance is an unfinished product which has not been subjected to a drying process in a pigment preparation process.

2. The method according to claim 1, wherein said wet mixing step is performed with adding at least one selected from the group consisting of a liquid and a surfactant.

3. The method according to claim 1, wherein the colorless toner particles are obtained by a pulverization process comprising the steps of melting and kneading a colorless toner particle material containing a binder resin but not a coloring agent, drying and pulverizing thus obtained kneaded material, and classifying thus pulverized kneaded material.

4. The method according to claim 1, wherein the colorless toner particles are obtained by polymerizing a binder resin raw material containing at least one material selected from the group consisting of a resin monomer, oligomer and pre-polymer.

5. A method of manufacturing a developing agent comprising the steps of:

wet mixing colorless toner particles containing a binder resin and a pigment wetted in advance to obtain wet toner particles; and drying said wet toner particles, to obtain toner particles, wherein said pigment is wetted with water.

* * * * *